US007290395B2

(12) United States Patent
Deal

(10) Patent No.: US 7,290,395 B2
(45) Date of Patent: Nov. 6, 2007

(54) HIGH POWER THERMOELECTRIC CONTROLLER

(75) Inventor: Jeffrey Deal, Clarence, NY (US)

(73) Assignee: GentCorp Ltd, Lancaster, NY (US)

( * ) Notice: Subject to any disclaimer, the term of this patent is extended or adjusted under 35 U.S.C. 154(b) by 272 days.

(21) Appl. No.: 11/244,667

(22) Filed: Oct. 6, 2005

(65) Prior Publication Data

US 2007/0079616 A1 Apr. 12, 2007

(51) Int. Cl.
*F25B 21/02* (2006.01)
*F25B 29/00* (2006.01)

(52) U.S. Cl. ..... 62/3.7; 62/159

(58) Field of Classification Search ..... 62/6.2, 62/6.3, 6.7, 214, 159; 165/255, 259, 118, 165/238, 268, 269; 372/34, 38.1
See application file for complete search history.

(56) References Cited

U.S. PATENT DOCUMENTS 4,357,804 A * 11/1982 Beitner ..... 62/3.7
4,631,728 A * 12/1986 Simons ..... 372/34
4,812,733 A * 3/1989 Tobey ..... 323/285
5,088,098 A 2/1992 Muller et al. ..... 372/34
5,245,835 A 9/1993 Cohen et al. ..... 62/159
5,450,727 A * 9/1995 Ramirez et al. ..... 62/3.7
5,564,276 A 10/1996 Abadilla et al. ..... 62/3.7
5,604,758 A * 2/1997 AuYeung et al. ..... 372/34
5,604,759 A * 2/1997 Miyaki et al. ..... 372/38.02
5,626,021 A 5/1997 Karunasari et al. ..... 62/3.5
5,689,957 A 11/1997 DeVilbiss et al. ..... 62/3.7
5,690,849 A 11/1997 DeVilbiss et al. ..... 219/497
5,871,526 A 2/1999 Gibbs et al. ..... 607/104
5,936,987 A * 8/1999 Ohishi et al. ..... 372/29.014
6,055,815 A 5/2000 Peterson ..... 62/3.7
6,205,790 B1 3/2001 Denkin et al. ..... 62/3.7
6,606,447 B2 * 8/2003 Brown et al. ..... 385/140
6,788,084 B2 * 9/2004 Jones et al. ..... 324/760
6,817,191 B2 * 11/2004 Watanabe ..... 62/3.7
6,978,624 B2 * 12/2005 Carlson et al. ..... 62/3.7
6,981,381 B1 * 1/2006 Wang et al. ..... 62/3.2
7,124,592 B2 * 10/2006 Tanaka ..... 62/3.2

FOREIGN PATENT DOCUMENTS

JP 8-219874 A * 8/1996

* cited by examiner

*Primary Examiner*—Mohammad M. Ali
(74) *Attorney, Agent, or Firm*—Walter W. Duft

(57) ABSTRACT

A high power thermoelectric controller system is disclosed, capable of operating multiple thermoelectric cooler (TEC) devices, each with a maximum power demand greater than 200 watts. The controller system utilizes interleaved triggering of multiple pulse width modulated power conversion circuits in order to minimize switching transient currents. In another aspect, the system incorporates a novel combination of a PWM controller circuit and H-bridge switching network into a single circuit that reduces the number of components needed to provide closed-loop proportional control of multiple TEC devices in a temperature control system.

20 Claims, 6 Drawing Sheets

HIGH POWER THERMOELECTRIC CONTROLLER

BACKGROUND OF THE INVENTION

1. Field of the Invention

The present invention relates to control systems for thermoelectric coolers (TECs) and more particularly relates to an efficient, small form-factor controller for two or more large TECs where the electrical power demand of each can exceed 200 watts.

2. Description of Prior Art

Thermoelectric coolers or Peltier devices have been applied to many uses, as varied as temperature control of semiconductor lasers devices and thermal imaging systems to portable refrigeration systems for automotive applications. In the case of the former, there is prior art embodied in a number of patents for systems that provide precise temperature control. Specifically, U.S. Pat. No. 5,088,098 of Muller, et al. teaches a simple temperature control system that utilizes pulse width modulation (PWM) of the electrical current supplied to the TEC device as the means to control rate at which the TEC device adds or removes thermal energy from the system requiring temperature control. This concept is further refined in U.S. Pat. No. 5,450,727 of Ramirez, et al. with the implementation of a temperature control feedback system wherein the error signal developed from the difference between a control input and the device temperature is the control input for a PWM current source. Finally, a closed loop TEC temperature control system with still further refinements for improved temperature regulation is taught in U.S. Pat. No. 6,205,790 of Denkin, et al. This patent claims advantages in the temperature control over prior art designs by limiting the maximum feedback error signal amplitude and zeroing the feedback error signal at operating point crossover. The cited prior art demonstrates significant advancement in the application of TEC devices to temperature control of small devices, e.g. semiconductors, wherein a single TEC device has sufficient thermal energy transfer capacity to control the system temperature.

When human beings are deployed to working environments with extreme temperatures, their capacity for physical labor and mental acuity may be greatly diminished because of the effect of very miniscule changes in body core temperature. This is especially evident when humans engage in underwater diving where the water temperature is only a few degrees warmer than normal body temperature. As the body absorbs thermal energy from the warm ambient environment, the diver will quickly become nauseous, disoriented and at risk of death. There is therefore a need to provide control of the diver's body core temperature on a real time basis. A closed-loop perfusion system with a working fluid may be employed to conduct excess heat away from the human body, and a heat pump system in the perfusion loop can then transfer the excess heat to the ambient environment. TEC devices are the solution of choice for the heat pump system in this application because of their simplicity, ruggedness and ability to both heat and cool without system reconfiguration.

For a temperature control system where the human body is immersed in water with an ambient temperature of +40° C., the required cooling capacity may be as high as 500 watts or more. Because the maximum cooling efficiency of TEC devices in this application is limited to approximately 50%, the total input power demand of the TEC devices may exceed 1000 watts. In one TEC system already constructed and demonstrated by applicant, the prime power voltage was 22 to 32 volts DC at a maximum load current of 70 amperes, and there were five TEC devices, each device drawing a peak current of 14 amperes at a voltage of 30 volts DC. The devices used were Model DL-290-24-00 sold by Supercool USA Inc. of San Rafael, Calif. A TEC heat pump control system for this type of application must therefore have the capability to deliver a large amount of power to multiple TEC devices. In addition, because such a system must be carried by a diver, the system weight and volume should be minimized in order to have minimum impact on diver mobility.

The three patents previously cited herein share a number of common characteristics, including the use of independent PWM energy conversion and polarity selection circuits, and the use of energy storage inductors to reduce the time-varying component of energy delivered to the TECs. In addition, the cited prior art teaches a single TEC device for each control system. While these characteristics may be advantageous for low-power applications as taught in the prior art, none of the cited prior art addresses the unique requirements of a man-portable system where multiple TEC devices operating in parallel are required in order to provide the required thermal energy transfer rates and where the power demand of each TEC device may exceed 200 watts. While it might be possible to realize a control system for this latter application in accordance with this prior art, the weight and volume of such a system would be untenable because of the number of components, especially with respect to the size and number of energy storage inductors required to realize a high-power multiple channel PWM energy conversion system.

SUMMARY OF THE INVENTION

The foregoing problems are solved and an advance in the art is provided by a novel thermoelectric controller system for multiple TEC devices with high total output power demand in a man-portable environment. In one aspect of the invention, the TEC controller system utilizes multiple PWM power controllers with interleaved timing for simultaneously controlling multiple TEC devices. In another aspect of the invention, the TEC controller system utilizes PWM power controllers that integrate the PWM functions and polarity control functions in order to reduce the component count and, hence, the overall size of the controller system. The PWM power controllers are unlike those identified in the prior art because they require no energy storage inductors, providing a system with reduced weight and volume.

It is therefore an object of the invention to provide a TEC controller system that will simultaneously control multiple TEC devices with high power demand (e.g., 200 watts or more for each TEC).

A further object of the invention is to provide a TEC controller system wherein multiple PWM controllers are simultaneously controlled and triggered in an interleaved manner to reduce the input current switching excursions.

A still further object of the invention is to provide a TEC controller system which integrates both PWM power control functions and TEC device polarity control in order to minimize control system component count and overall system size.

BRIEF DESCRIPTION OF THE DRAWINGS

The foregoing and other features and advantages of the invention will be apparent from the following more particular description of exemplary embodiments of the invention, as illustrated in the accompanying Drawings in which.

DETAILED DESCRIPTION OF PREFERRED EMBODIMENTS

Introduction

An exemplary TEC temperature controller system will now be described, together with a temperature controlled microclimate system that incorporates a multi-channel TEC temperature controller system therein. Advantageously, the TEC temperature controller system embodiments disclosed herein are characterized by their ability to control multiple TEC devices operating in parallel with a total maximum power demand in excess of 1000 watts.

Illustrated Embodiments

Figure 1:
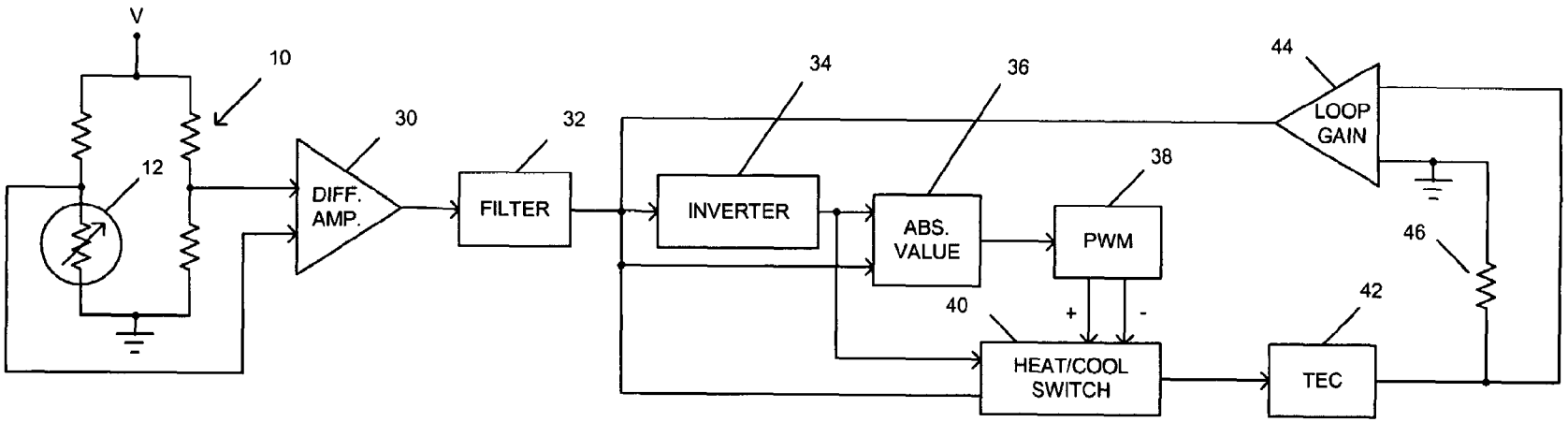
Figure 1 (Prior Art)
FIG. 1 is a functional block diagram of a prior art TEC temperature control system that utilizes basic PWM power control.

Turning now to the Drawings wherein like reference numerals signify like elements in all of the several views, FIG. 1 illustrates a functional block diagram for a TEC temperature control system as disclosed in U.S. Pat. No. 5,088,098 of Muller, et al. In this patent, the inventor teaches the use of a simple "Type 1" servo loop wherein the temperature of a device which is to be controlled (a small laser) is sensed by a Thermistor 12 incorporated in a Resistance Bridge 10. As the Thermistor 12 temperature deviates from a pre-established set-point, the error voltage developed in the Resistance Bridge 10 is boosted in a Differential Amplifier 30 and applied to a low-pass Filter 32 that slows the overall system response in order to prevent overall system oscillation. The filtered error voltage is applied to an Inverter 34 and an Absolute Value circuit 36 to develop an error signal with a unipolar characteristic. That is, the magnitude of the error signal is proportional to the temperature deviation and the polarity of the error signal is the same regardless of whether the temperature deviation is positive or negative. This unipolar error signal is applied to the control input of a PWM power supply circuit 38 so that the voltage output of this circuit is directly proportional to the temperature deviation from the set point. The filtered and inverted error voltage is also provided as an input to the Heat/Cool Switch 40 circuitry. This error signal will have a nominal value when the thermistor 12 temperature is at the predetermined set point, and the polarity of the deviation of this voltage from the nominal value will determine whether the system is to provide heating or cooling.

The magnitude of the current applied to the TEC 42 will therefore be proportional to the temperature deviation from the pre-established set point, and the polarity of the current applied to the TEC 42 will be determined by the direction of temperature deviation. The patent also discloses a means of sampling the current delivered to the TEC 42, applying a voltage proportional to the current to a Loop Gain Amplifier 44 and using the amplified voltage to modify the gain of the control loop.

Figure 2:
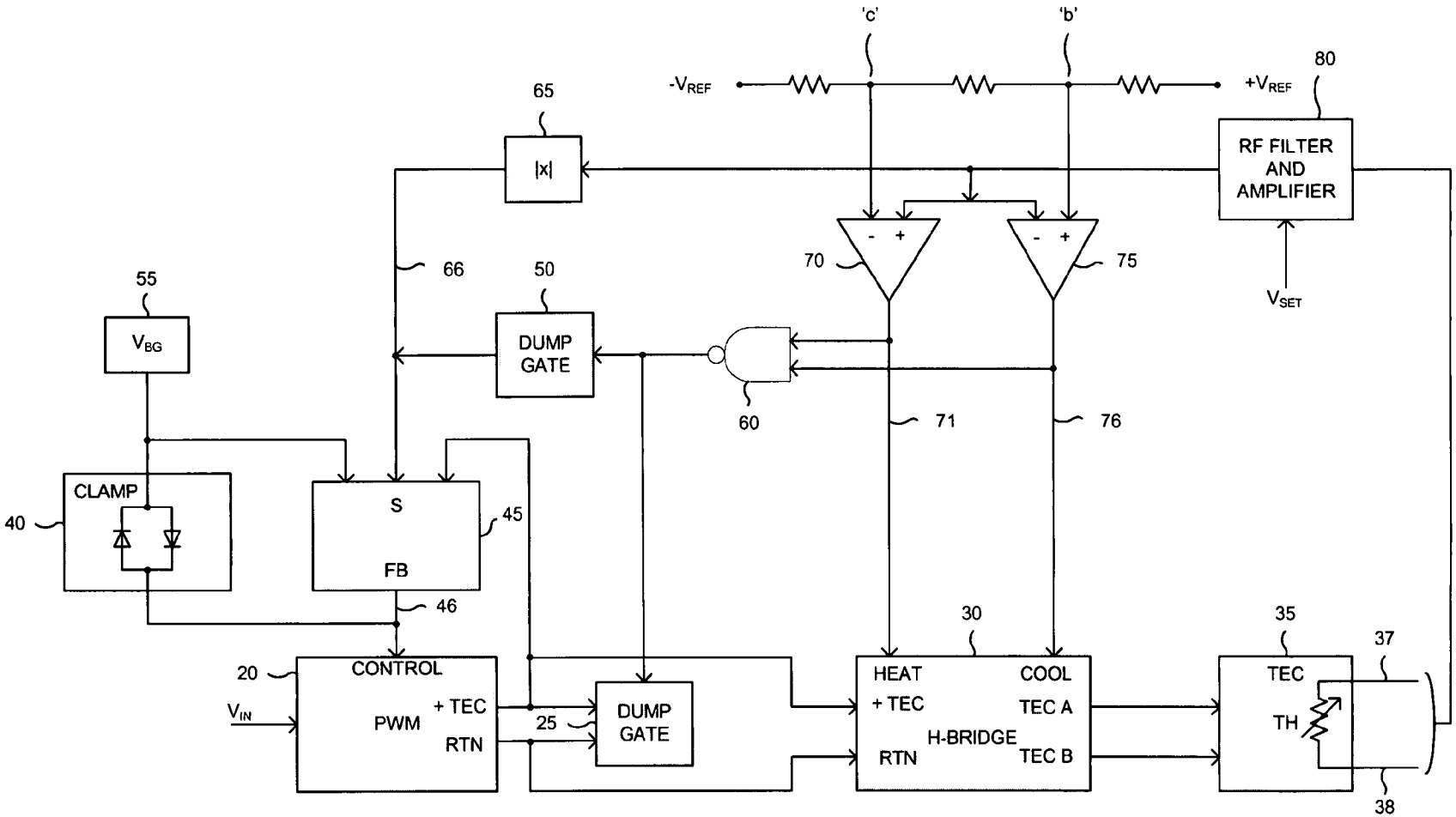
Figure 2 (Prior Art)
FIG. 2 is a functional block diagram of a second prior art TEC temperature control system that utilizes basic PWM power control with feedback rate limiting and operating point crossover zeroing.

A similar closed-loop control system is disclosed in U.S. Pat. No. 6,205,790 of Denkin, et al. and shown in FIG. 2. This system includes many of the same functional blocks as has been taught by Muller, including a temperature sensing Thermistor 37 and 38, Error Amplifier 80 and Absolute Value Circuit 65, PWM Current Source 20 and Heat/Cool Switch implemented with an H-Bridge Circuit 30. Again, like U.S. Pat. No. 5,088,098 of Muller et al., the disclosed system is suitable for controlling a small TEC device that is used to regulate the temperature of a small laser device.

Figure 3:
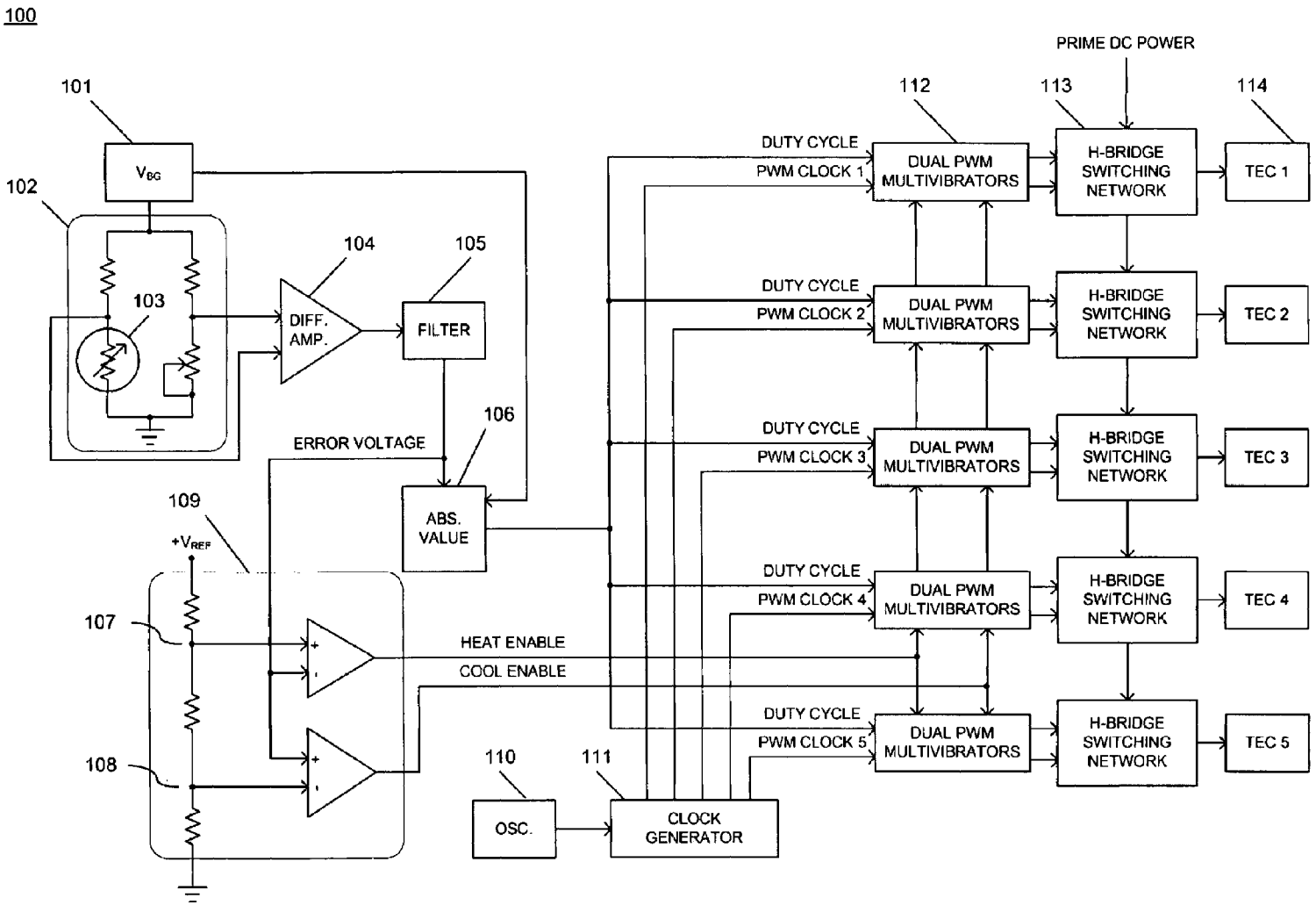
FIG. 3 is a functional block diagram of an exemplary embodiment of the present invention in which five TEC devices are controlled.

Turning now to FIG. 3, an exemplary TEC Thermoelectric Controller System 100 is shown that is suitable for high-power use in a man-portable microclimate control system. Although not illustrated, a working fluid (such as water) for which the temperature is to be controlled is in contact with a Thermistor 103 that is part of a Resistance Bridge 102. The excitation for the resistance bridge is provided by a conventionally-available precision band-gap voltage reference circuit $V_{BG}$ 101, to minimize control error due to supply voltage instability. The resistance bridge is adjusted for a balanced condition when the thermistor is at the desired control temperature. The resistance bridge output voltage is applied to a Differential Amplifier 104 that provides an amplified error signal suitable for further processing. A low-pass Filter 105 is provided in the error signal path to slow the overall system response in order to prevent overall system oscillation. The filtered output, ERROR VOLTAGE, is applied to an Absolute Value Circuit 106 and a Window Voltage Comparator Circuit 109. The absolute value circuit serves the same function here as was previously described for the prior art control systems. That is, the PWM Multivibrator Circuits 112 require a control voltage, DUTY CYCLE, which is proportional to the temperature deviation from the desired set point, regardless of whether the deviation is positive or negative. The Absolute Value Circuit 106 converts the bipolar ERROR VOLTAGE excursions to a unipolar error voltage.

In order to effect control of the TECs for heating or cooling, the polarity of the output voltages of the control system applied to the TECs must be invertable. The ERROR VOLTAGE polarity with respect to the nominal value at the temperature set point is indication of whether heating or cooling is required. The ERROR VOLTAGE is compared to an Upper Threshold Voltage at node 107 and a Lower Threshold Voltage at node 108. When the error voltage is between the upper and lower threshold values both outputs of the Window Comparator 109 are negated and the system is not operational. If the Thermistor 103 temperature falls and the ERROR VOLTAGE rises in response to the temperature change, when the value of the ERROR VOLTAGE exceeds the Upper Threshold Voltage 107 the HEAT ENABLE output of the Window Comparator 109 will be asserted. This will enable one of the two PWM multivibrator circuits within each Dual PWM Multivibrator 112 and begin to transfer energy to the TEC devices. Conversely, if the Thermistor 103 temperature rises and the ERROR VOLTAGE falls in response to the temperature change, when the value of the ERROR VOLTAGE falls below the Lower Threshold Voltage 108 the COOL ENABLE output of the Window Comparator 109 will be asserted. This will enable the other PWM multivibrator circuit within each Dual PWM Multivibrator 112 and begin to transfer energy to the TEC devices, but at an opposite polarity. The output signals from the Dual PWM Multivibrator circuits 112 drive the H-Bridge Output Circuits 113 which then transfer energy to the TEC devices 114. The operation described thus far is essentially identical to that embodied in the prior art, except that the latter contemplates only a single PWM circuit controlled by a single TEC.

Figure 4:
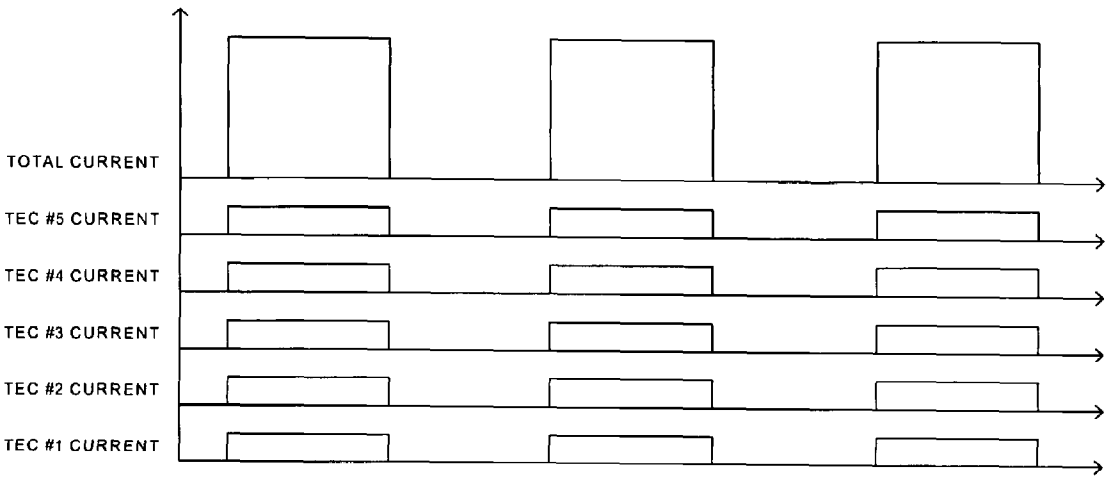
FIG. 4 is a representative graph of the input current and individual TEC output currents versus time for a five-output TEC controller where all TEC outputs are simultaneously enabled.

As previously stated, the cooling requirements for a microclimate system require the use of multiple high-capacity TEC devices. Conventional wisdom suggests that the simplest system configuration to meet this requirement would be to connect the electrical terminals of the many TEC devices in parallel to a single PWM circuit and thereby treat them as a single device. This is not an ideal solution however, because it dramatically increases the power output requirements for the control circuitry and it leads to very large switching currents when PWM control is used. Refer now to FIG. 4 which is a graphical representation of current versus time. The load current for five TEC devices (TEC #1-5 CURRENT) and the total required input current (TOTAL CURRENT) are represented on the ordinate axis. In a PWM control system, the delivered energy is directly proportional to the ratio of the output switch "ON" time to the total switching period, also known as the duty cycle. In the example of FIG. 4 the duty cycle is approximately 50%. Since all TEC devices are switched on and off simultaneously, the total input current will transition between a minimum and maximum twice during each switching period. As is well known to those skilled in the art of switching power conversion circuits, the rapid transition of switching current at high current levels gives rise to deleterious effects due to stray inductance in circuit components and interconnections. In the case of a system already reduced to practice, if this parallel TEC configuration had been implemented, the total input current excursion would have been 60 amperes, switched in approximately 10 microseconds.

Figure 5:
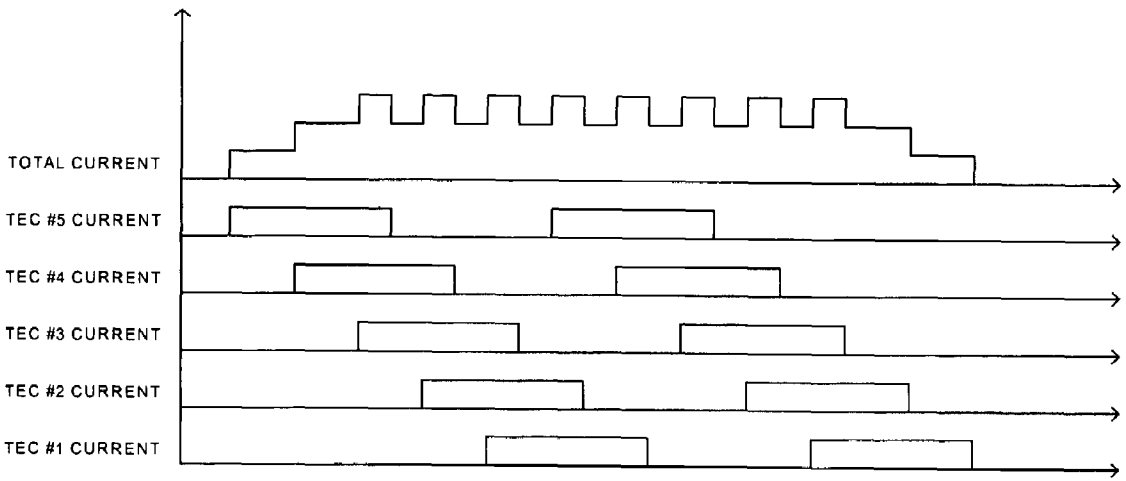
FIG. 5 is a representative graph of the input current and individual TEC output currents versus time for an exemplary five-output TEC controller with interleaved timing in accordance with the present invention.

The Controller System 100 overcomes the foregoing problem by providing a PWM Multivibrator Circuit 112 for each TEC 114, and by interleaving their timing so that the switching of all TEC device output currents does not occur simultaneously. Referring to FIG. 5, the trigger timing of the PWM Multivibrator Circuits 112 is equally divided across the total switching period so that only one TEC 114 is switching on or off at any given instant. For the case shown in FIG. 5 where the TEC device duty cycle is 50%, the total input current never changes by more than the load current of a single TEC 114 at any instant. This condition will be true regardless of the duty cycle of the output current waveform. The circuitry responsible for this interleaved timing is the Clock Generator circuit 111, an exemplary construction of which is shown in FIG. 6.

Figure 6:
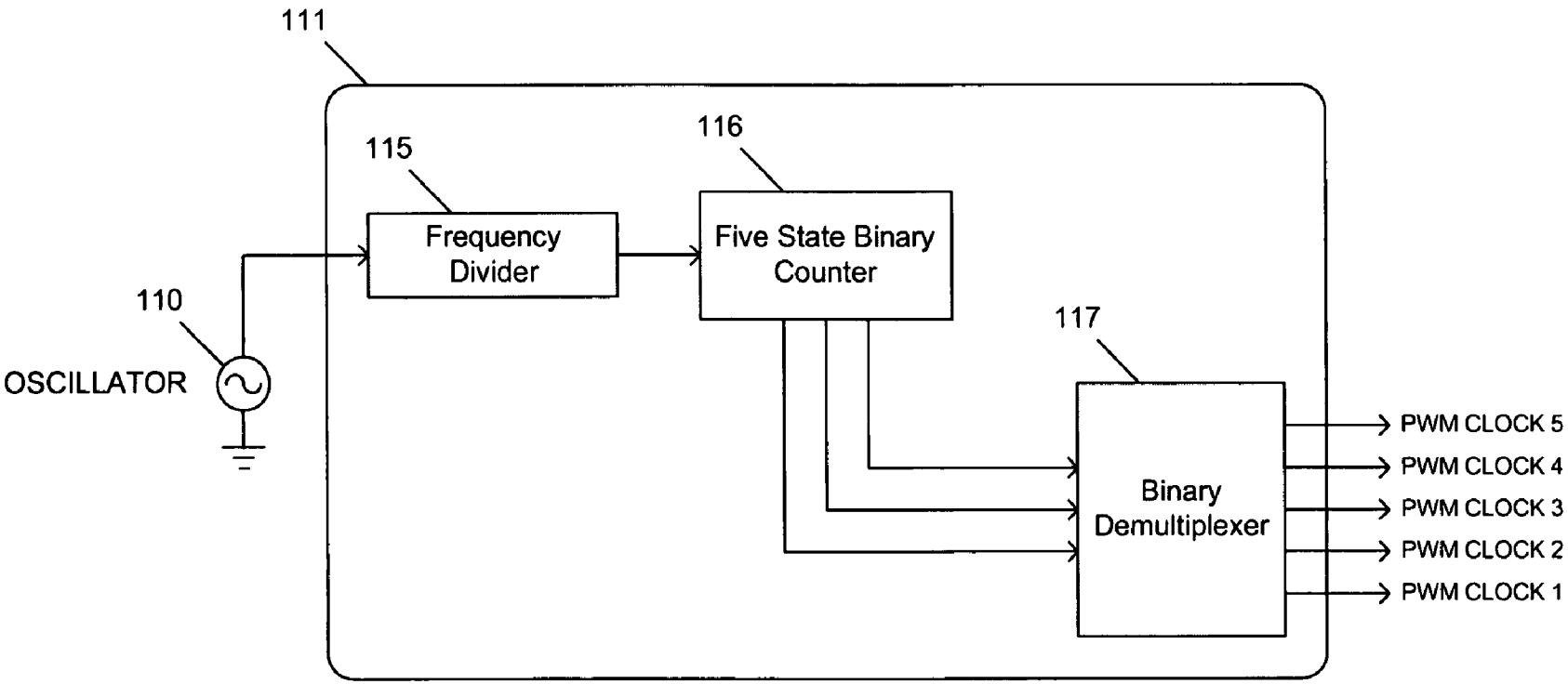
FIG. 6 is a functional block diagram of an exemplary clock generation circuit that provides interleaved timing control according to a first aspect of the present invention.

In FIG. 6, an Oscillator 110 provides a stable high-speed timing signal for the entire Controller System 100. This timing signal is applied to a Frequency Divider 115 which provides a timing signal at a lower output frequency. In the case of the system already reduced to practice, the fundamental switching period for the PWM Multivibrator Circuits 112 was established at 1 kHz so that the PWM multivibrator trigger transitions take place at five times that rate, or 5 kHz. The Frequency Divider 115 therefore provides an output clock signal at a frequency of 5 kHz. This clock is applied to a Five State Binary Counter 116 which provides a sequential binary output with five contiguous values, the pattern repeating itself at a 1 kHz rate. The binary code output of the counter is applied to the inputs of a Binary Demultiplexer 117. The five outputs (PWM CLOCK 1-5) of the Binary Demultiplexer 117 that correspond to the five binary states of the inputs will be asserted in regular sequence with the pattern repeating at the 1 kHz rate. As shown in FIG. 3, the PWM CLOCK 1-5 outputs are respectively provided to the five PWM Multivibrator Circuits 112. The outputs are provided in staggered fashion, thereby providing the interleaved TEC current control characteristics of FIG. 5.

Figure 7:
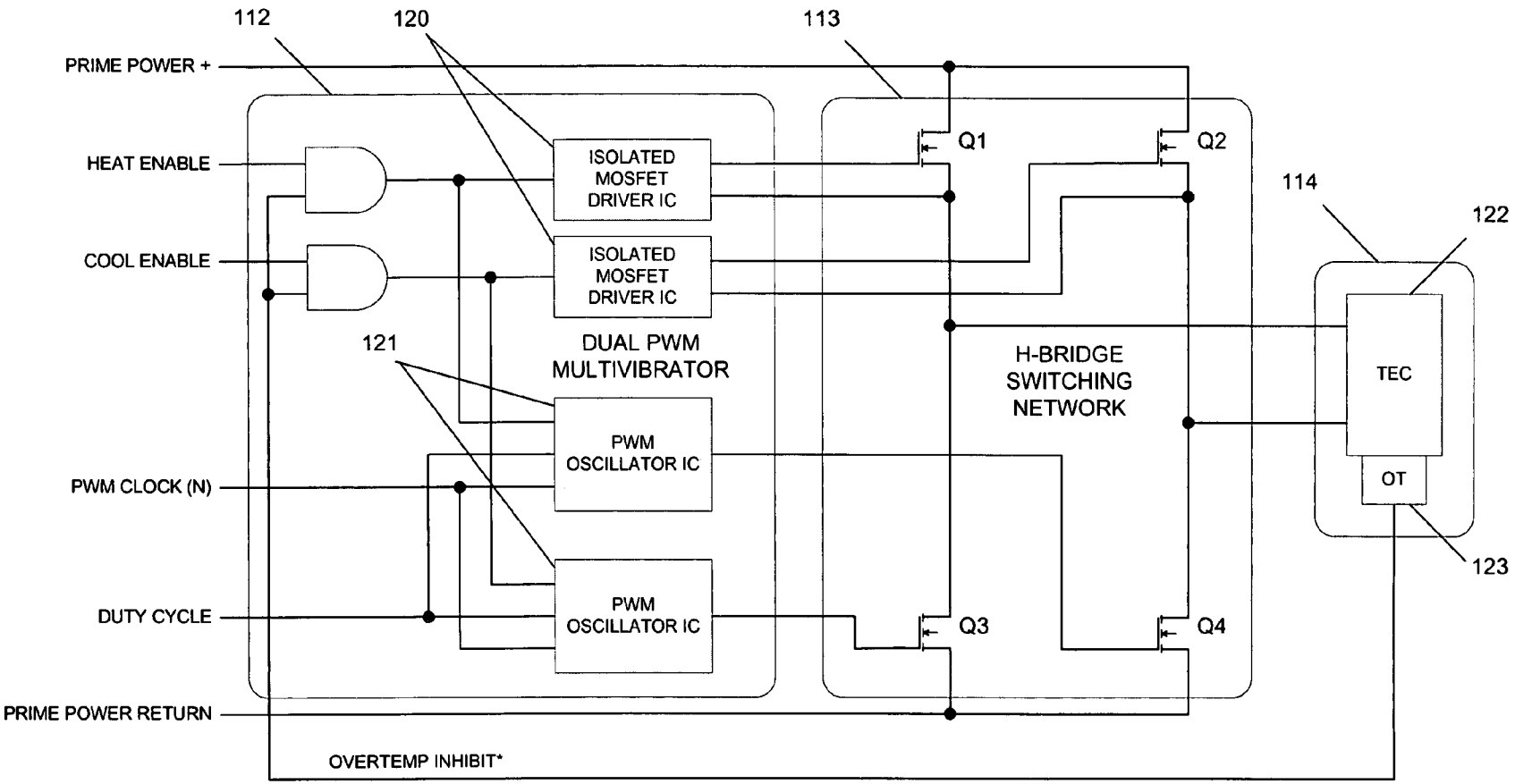
FIG. 7 is a functional block diagram of an exemplary single channel PWM power controller with reduced component count and size according to a second aspect of the present invention.

Turning now to FIG. 7, a second aspect of the invention will now be described in which a single Dual PWM Multivibrator 112 and H-Bridge Switching Network 113 are connected to a TEC device 114, in order to reduce component number and size. In U.S. Pat. No. 6,205,790 of Denkin, et al. and U.S. Pat. No. 5,450,727 of Ramirez, et al., the PWM power control function and output polarity switching functions are implemented in separate circuitry. A traditional H-bridge switching network requires four switching transistors capable of carrying the TEC device output current and the PWM power control function requires an additional switching transistor also capable of carrying the TEC device output current on a time-averaged basis. The disclosures in U.S. Pat. Nos. 5,450,727 and 6,205,790 therefore require five switching transistors capable of supporting the TEC device output current. In the case of U.S. Pat. No. 5,088,098 of Muller, et al., the PWM power control circuit is implemented by a single monolithic integrated circuit with transformer coupling, where the PWM power switching device is part of the integrated circuit. While this configuration negates the need for a traditional H-bridge switching network it should be clear to those skilled in art that the monolithic integrated circuit PWM controller is not capable of delivering the 200 watts or more that would be required to power just one of the five TEC devices used in the thermoelectric control system disclosed herein. The inductor also adds undesirable weight and bulk to the device.

The circuit of FIG. 7 provides PWM control system with an H-bridge switching circuit that integrates the PWM control function with the polarity selection function. This reduces the total number of components required to realize the control system and therefore provides a system with reduced weight and volume (while satisfying high power requirements). The Dual PWM Multivibrator 112 is comprised of two identical Isolated MOSFET Driver 120 circuits and two identical PWM Multivibrator 121 circuits. These circuits are enabled in pairs by assertion of the HEAT ENABLE signal or, alternatively, the COOL ENABLE signal. In each case, when the respective enable signal is asserted, the corresponding Isolated MOSFET Driver 120 circuit provides a galvanically isolated gate bias voltage to the high-side MOSFET (Q1 or Q2) to cause the MOSFET to conduct. This will connect one of the TEC 114 terminals to the PRIME POWER+circuit, depending on which enable signal is asserted. At the same time, the corresponding PWM Multivibrator 121 circuit will be enabled. This circuit will generate an output voltage waveform that provides gate bias to the corresponding low-side MOSFET (Q4 or Q3.) The gate bias waveform will have a duty cycle that is proportional to the amplitude of the DUTY CYCLE input voltage applied to the PWM circuit so that the time-averaged conduction of the MOSFET transistor will be proportional to the DUTY CYCLE control signal. The low-side MOSFET will connect the second TEC 114 terminal to the PRIME POWER RETURN circuit with pulse width modulation to supply energy to the TEC 114. As is the case for all H-bridge circuits, the MOSFET transistors are energized in diagonal pairs, e.g. Q1/Q4 or Q2/Q3.

It will be seen that the circuit of FIG. 7 requires only four switching transistors, rather than five (as in U.S. Pat. No. 6,205,790 of Denken et al. and U.S. Pat. No. 5,450,727 of Ramirez). Moreover, the monolithic integrated circuit/transformer coupling approach disclose in U.S. Pat. No. 5,088,098 of Muller et al., with its attendant power restrictions and weight/bulk issues, is also avoided.

An additional feature of the preferred embodiment described here is the incorporation of overtemperature protection for the TECs 114. The TECs 114 that were used incorporate a thermal switch OT 123 that actuates in the event that the operating temperature of the TEC module exceeds a safe value. The output of this switch, OVERTEMP INHIBIT*, is a high logic level when negated and is supplied as an input to the PWM Multivibrator circuits 120/121 (via AND logic gates) in order to inhibit the circuits and remove TEC power in the event of an overtemperature condition while an enable signal is present.

Rationale for Configuration

The configuration of components and circuitry described above in connection with the various drawing figures, provides a new thermoelectric controller system to control multiple high-power TEC devices. These configurations provide the additional benefit of a system that is suitable for a man-portable operation with a minimum of additional weight and volume.

Accordingly, a high power thermoelectric controller system has been disclosed and the objects of the invention have been achieved. Although various embodiments have been shown and described, the description and the drawings herein are merely illustrative, and it will be apparent that the various modifications, combinations and changes can be made of these structures disclosed in accordance with the invention. It should be understood, therefore, that the invention is not to be in any way limited except in accordance with the spirit of the appended claims and their equivalents.

I claim:

1. A high power thermoelectric controller system for controlling plural high power thermoelectric cooler devices, comprising:

a temperature sensor;

plural power supply circuits each adapted produce a pulsatile power output to one of said thermoelectric cooler devices, said power output having a switching duty cycle determined by an output of said temperature sensor;

a clock generator having plural clock outputs respectively adapted to drive one of said power supply circuits; and said clock outputs delivering interleaved clock signals to said power supply circuits so that said power outputs do not all switch simultaneously.

2. A thermoelectric controller system in accordance with claim 1, wherein said clock signals are interleaved such that only one power output is switching at any given instant.

3. A thermoelectric controller system in accordance with claim 1, wherein said clock signals are interleaved such that said power outputs are switched at equally spaced intervals over a total switching period for all power outputs.

4. A thermoelectric controller system in accordance with claim 1, wherein said clock generator receives signal pulses originating from an oscillator and comprises a repeating binary counter producing a repeating count of said pulses over a count range corresponding to the number of said power supply circuits, and a binary demultiplexer providing said plural clock outputs according to count values of said repeating count.

5. A thermoelectric controller system in accordance with claim 4, wherein said clock generator further includes a frequency divider that receives said signal pulses from said oscillator and performs a frequency division to provide a subset of said signal pulses to said binary counter.

6. A high power thermoelectric controller system for controlling plural high power thermoelectric cooler devices, comprising:

a temperature sensor;

plural power supply circuits each adapted produce a pulsatile power output to one of said thermoelectric cooler devices, said power output having a switching duty cycle determined by an output of said temperature sensor;

each of said power supply circuits having pulse generating circuitry and integrated polarity control circuitry that controls whether one of said thermoelectric cooler devices is operating in a heating or cooling mode; and a clock generator adapted to drive said power supply circuits.

7. A thermoelectric controller system in accordance with claim 6, wherein said pulse generating circuitry comprises a pair of pulse generators driven by clock signals and being enabled by separate inputs that respectively represent heat enable and cool enable signals, said pulse generators being respectively adapted to provide a heat select output and a cool select output to said polarity control circuitry for selectively controlling one of said thermoelectric cooler devices to operate in said heating or cooling mode.

8. A thermoelectric controller system in accordance with claim 7, wherein said polarity control circuitry comprises an H-bridge switching network driven by a pair of switch drivers that are respectively enabled by said heat enable and cool enable signals, said switch drivers operating in conjunction with said pulse generators to control said switching network to switch the polarity of said power output to one of said thermoelectric cooler devices to cause said thermoelectric cooler device to operate in said heating or cooling mode.

9. A thermoelectric controller system in accordance with claim 8, further including an over-temperature input from said thermoelectric cooler device and associated logic for de-asserting said power output in response to an over-temperature signal on said over-temperature input.

10. A high power thermoelectric control method for controlling plural high power thermoelectric cooler devices, comprising:

sensing a temperature and producing a temperature sensing output;

providing said temperature sensing output to plural power supply circuits each adapted produce a pulsatile power output to one of said thermoelectric cooler devices, said power output having a switching duty cycle determined by an output of said temperature sensor;

generating plural clock signals and providing respective ones of said signals to drive said power supply circuits; and said clock signals being interleaved so that said power outputs do not all switch simultaneously.

11. A thermoelectric control method in accordance with claim 10, wherein said clock signals are interleaved such that only one power output is switching at any given instant.

12. A thermoelectric control method in accordance with claim 10, wherein said clock signals are interleaved such that said power outputs are switched at equally spaced intervals over a total switching period for all power outputs.

13. A thermoelectric control method in accordance with claim 10, wherein said clock signal generating comprises receiving signal pulses, producing a repeating count of said pulses over a count range corresponding to the number of said power supply circuits, and providing said plural clock signals according to count values of said repeating count.

14. A thermoelectric control method in accordance with claim 13, wherein said clock signal generating further comprises performing a frequency division on said received signal pulses and providing a subset of said signal pulses for use in producing said repeating count of said pulses.

15. A high power thermoelectric control method for controlling plural high power thermoelectric cooler devices, comprising:

sensing a temperature and producing a temperature sensing output;

providing plural power supply circuits each adapted produce a pulsatile power output to one of said thermoelectric cooler devices, said power output having a switching duty cycle determined by an output of said temperature sensor;

each of said power supply circuits having pulse generating circuitry and integrated polarity control circuitry that controls whether one of said thermoelectric cooler devices is operating in a heating or cooling mode; and generating a clock signal to drive said power supply circuits.

16. A thermoelectric control method in accordance with claim 15, wherein said pulse generating circuitry comprises a pair of pulse generators driven by clock signals and being enabled by separate inputs that respectively represent heat enable and cool enable signals, said pulse generators being respectively operated to provide a heat select output and a cool select output to said polarity control circuitry for selectively controlling one of said thermoelectric cooler devices to operate in said heating or cooling mode.

17. A thermoelectric control method in accordance with claim 16, wherein said polarity control circuitry comprises an H-bridge switching network driven by a pair of switch drivers that are respectively enabled by said heat enable and cool enable signals, said switch drivers being operated in conjunction with said pulse generators to control said switching network to switch the polarity of said power output to one of said thermoelectric cooler devices to cause said thermoelectric cooler device to operate in said heating or cooling mode.

18. A thermoelectric control method in accordance with claim 17, further including receiving an over-temperature signal from said thermoelectric cooler device and de-asserting said power output in response to said over-temperature signal.

19. A high power thermoelectric controller system for controlling plural high power thermoelectric cooler devices, comprising:

a temperature sensor;

plural power supply circuits each adapted produce a pulsatile power output to one of said thermoelectric cooler devices, said power output having a switching duty cycle determined by an output of said temperature sensor;

a clock generator having plural clock outputs respectively adapted to drive one of said power supply circuits;

said clock outputs delivering interleaved clock signals to said power supply circuits so that said power outputs do not all switch simultaneously;

said clock signals being interleaved such that only one power output is switching at any given instant and such that said power outputs are switched at equally spaced intervals over a total switching period for all power outputs;

said clock generator receiving signal pulses originating from an oscillator and comprising a repeating binary counter producing a repeating count of said pulses over a count range corresponding to the number of said power supply circuits, and a binary demultiplexer providing said plural clock outputs according to count values of said repeating count; and said clock generator further including a frequency divider that receives said signal pulses from said oscillator and performs a frequency division to provide a subset of said signal pulses to said binary counter.

20. A high power thermoelectric controller system for controlling plural high power thermoelectric cooler devices, comprising:

a temperature sensor;

plural power supply circuits each adapted produce a pulsatile power output to one of said thermoelectric cooler devices, said power output having a switching duty cycle determined by an output of said temperature sensor;

each of said power supply circuits having pulse generating circuitry and integrated polarity control circuitry that controls whether one of said thermoelectric cooler devices is operating in a heating or cooling mode;

a clock generator adapted to drive said power supply circuits;

said pulse generating circuitry comprising a pair of pulse generators driven by clock signals and being enabled by separate inputs that respectively represent heat enable and cool enable signals, said pulse generators being respectively adapted to provide a heat select output and a cool select output to said polarity control circuitry for selectively controlling one of said thermoelectric cooler devices to operate in said heating or cooling mode;

said polarity control circuitry comprising an H-bridge switching network driven by a pair of switch drivers that are respectively enabled by said heat enable and cool enable signals, said switch drivers operating in conjunction with said pulse generators to control said switching network to switch the polarity of said power output to one of said thermoelectric cooler devices to cause said thermoelectric cooler device to operate in said heating or cooling mode; and an over-temperature input from said thermoelectric cooler device and associated logic for de-asserting said power output in response to an over-temperature signal on said over-temperature input.

* * * * *